US009902525B2

(12) United States Patent
Herman

(10) Patent No.: US 9,902,525 B2
(45) Date of Patent: Feb. 27, 2018

(54) HINGED ONE PIECE DIVIDER FOR CONTAINER ASSEMBLY

(71) Applicant: ORBIS Corporation, Oconomowoc, WI (US)

(72) Inventor: Daniel Herman, Rochester Hills, MI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 15/165,257

(22) Filed: May 26, 2016

(65) Prior Publication Data

US 2016/0376062 A1 Dec. 29, 2016

Related U.S. Application Data

(60) Provisional application No. 62/184,586, filed on Jun. 25, 2015.

(51) Int. Cl.
*B65D 25/06* (2006.01)

(52) U.S. Cl.
CPC ..... *B65D 25/06* (2013.01)

(58) Field of Classification Search
CPC ..... B65D 25/06; B65D 25/04; A47B 65/15; A47B 65/10
USPC ..... 220/529, 531, 552, 510, 509, 507; 211/184; 206/561, 521.3, 521.4
See application file for complete search history.

(56) References Cited

U.S. PATENT DOCUMENTS 1,539,875 A * 6/1925 Schwartzberg ..... B65D 85/327 206/521.4
1,756,866 A * 4/1930 Hutchings ..... B42F 17/02 220/531
1,823,285 A * 9/1931 Petritsch ..... A47B 88/90 211/184
2,113,459 A * 4/1938 Brundin ..... B65D 85/325 206/521.4
2,743,030 A * 4/1956 Read, Jr. ..... B65D 1/243 211/126.1
3,200,988 A * 8/1965 De Chelbor ..... B65D 7/14 206/509
3,656,650 A * 4/1972 Frater ..... B65D 25/06 220/510
5,161,682 A * 11/1992 Seifert ..... G11B 33/0438 206/308.1

* cited by examiner

*Primary Examiner* — Robert J Hicks
(74) *Attorney, Agent, or Firm* — Greensfelder, Hemker & Gale, P.C.

(57) ABSTRACT

A container with a plurality of compartments is provided where each compartment includes a divider panel, or a portion thereof, that is rotatable about a pivot point. The divider panels (or portions thereof) pivot at the same time. The divider panels can each include a lower divider panel portion hingedly connected to an upper divider panel portion.

20 Claims, 4 Drawing Sheets

HINGED ONE PIECE DIVIDER FOR CONTAINER ASSEMBLY

CROSS-REFERENCE TO RELATED APPLICATIONS

This Application claims the benefit of U.S. Provisional Application No. 62/184,586 filed Jun. 25, 2015, the contents of which are incorporated herein by reference and made a part hereof.

FEDERALLY SPONSORED RESEARCH OR DEVELOPMENT

N/A

FIELD OF THE INVENTION

The present invention generally relates to a container having a plurality of interior compartments and a plurality of divider panels—one in each compartment—that collectively rotate together about a pivot point.

BACKGROUND OF THE INVENTION

When transporting goods, it is important to design containers that are easy to use and allow for the most efficient and economical use of space. This can be difficult when the parts or goods being transported are not conventionally shaped.

The present invention provides an improved container with a moveable divider panel for efficiently loading and unloading parts.

SUMMARY OF THE INVENTION

The present invention provides a container for transporting parts having unconventional shapes. The container includes a plurality of compartments for holding the parts. The compartments include divider panels that create separate areas in the compartments for two parts. The divider panels include an upper portion that can be rotated about a pivot point. The upper portions of the divider panels are connected together so that they can be moved at the same time. This facilitates loading and unloading of the parts.

Specifically, the container can be used for loading parts having a larger size at one end or portion of the part. A first part can be placed in one area of a compartment (i.e., on one side of the divider panel) with the larger portion placed at the bottom of the compartment. A second part can be placed in the other area of the compartment (i.e., on the other side of the divider panel) with the larger portion placed proximate the top of the compartment. The divider panel is pivoted to accommodate placement of the two parts.

In accordance with one embodiment of the invention, a container for carrying a plurality of parts is provided. The container comprises a container body having a rectangular bottom wall, a first side wall, a second side wall, a first end wall and a second end wall, the bottom wall, first side wall, second side wall, first end wall and second end wall defining an interior portion. The container can be formed from plastic or other suitable materials.

The container further includes a plurality of spaced parallel walls in the interior of the container. Each of the plurality of walls extends from proximate the first side wall to proximate the second side wall and defines a plurality of compartments in the interior of the container body. A plurality of divider panels extend upward from the bottom wall—one divider panel in each of the plurality of compartments. Each of the plurality of divider panels has at least an upper portion pivotable from a first position to a second position. An upper connector piece, such as a rod, is connected to each of the divider panels.

Each of the plurality of divider panels can include a lower divider panel portion hingedly connected to an upper divider panel portion at a pivot point. The lower divider panel portions extend upward from the bottom of the container at a position that is off center with respect to a center line of each end wall. This off center position accommodates the larger portion to be positioned proximate the bottom of the compartment on one side of the divider panel.

The lower divider panel portions can be connected together as a single strip of material. Alternatively, the lower divider panel portions can be separate pieces.

The compartments can be a separate unit placed in the container body (e.g., dunnage). Alternatively, the compartments can be fixedly connected to the container body.

Each compartment can include a first side wall and a second side wall. Similarly, each compartment can include a bottom wall. Alternatively, the outer container can be used for the side and bottom walls.

In another embodiment of the invention, a container with simultaneously moving divider panels is provided. The container comprises a container body having a bottom wall, a first side wall and a second side wall. The container can also include a first end wall and a second end wall. A plurality of compartments is positioned in an interior of the container body. Each compartment includes a divider panel having a lower panel portion and an upper panel portion pivotably connected to the lower panel portion. Each of the upper panel portions of the divider panel are connected together so that each upper panel portion pivots simultaneously with the other upper panel portions.

Each of the upper panel portions of the divider panels can be connected to each other at a top portion of each upper panel portion. A connector piece, such as a rod, can be used to connect each of the top portions of each of the upper panel portions.

Each of the lower panel portions of the divider panels are off center with respect to a center line extending from a first end to a second end of the bottom wall. Thus, one of the areas formed in each compartment has a larger bottom portion than the other.

The compartments can be defined by a plurality of end walls. The end walls can be in a parallel spaced relationship.

Each compartment can include a first side wall and a second side wall. Similarly, each compartment can include a bottom wall.

Further aspects of the invention are disclosed in the Figures and are described herein.

BRIEF DESCRIPTION OF THE DRAWINGS

To understand the present invention, it will now be described by way of example, with reference to the accompanying drawings in which.

DETAILED DESCRIPTION

Figure 1:
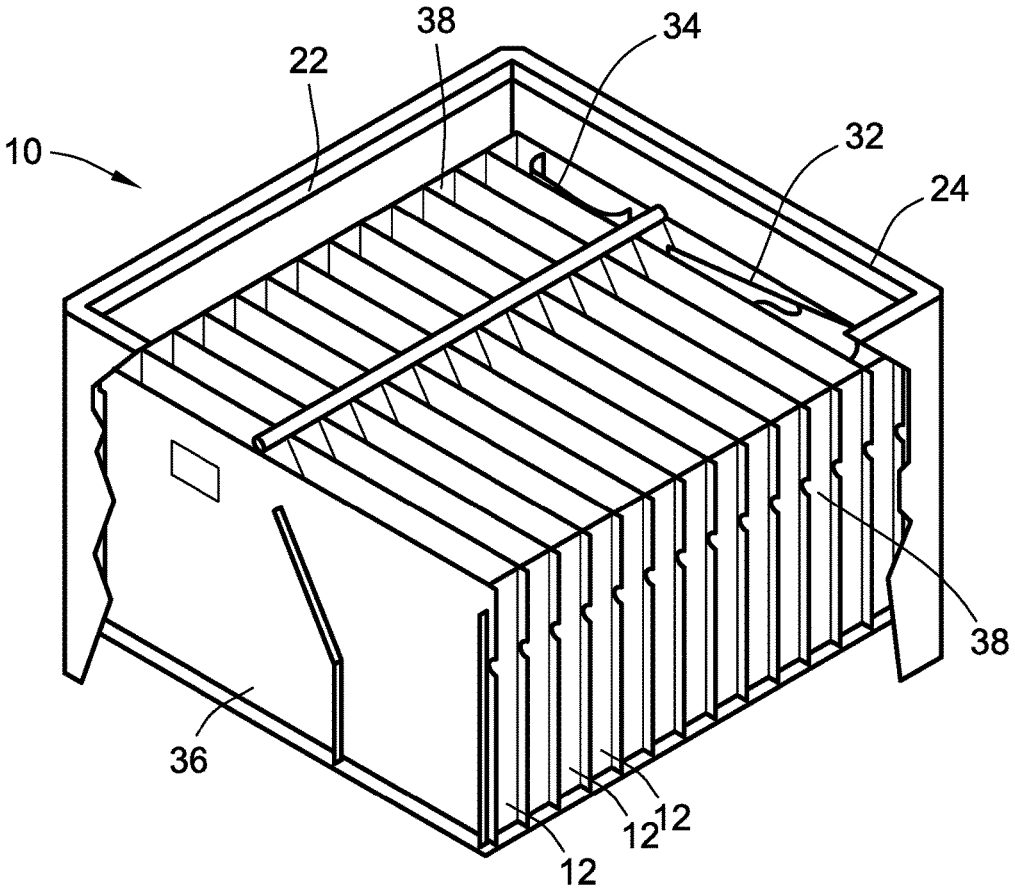
FIG. 1 is a perspective view of a partial container (having the front facing side and end panels removed) having a pivotable divider panel in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to container having an outer body 10 with an interior portion having multiple compartments 12 for holding and transporting unconventionally shaped parts 14. Each of the compartments 12 is designed to receive two parts 14. Each compartment 12 includes a divider panel 16 for separating each compartment 12 into two spaces—one for each part 14. The divider panels 16, or at least an upper portion 18 of each of the divider panels 16, are pivotable about a hinged pivot point 20 to facilitate loading and unloading of the parts 14.

The container body 10 includes two side walls and two end walls. FIG. 1 shows the container body 10 with only a first side wall 22 and a first end wall 24. The front facing second side wall 26 and second end wall 28 have been removed to more clearly see the interior of the container body 10 (however, these walls are visible in FIGS. 3 and 4). The side and end walls 22, 24, 26 and 30 extend upward from a bottom wall 30.

The interior of the container body 10 includes a plurality of compartments 12 configured to receive parts 14. The compartments 12 can be single unit of dunnage that is loosely held in the container body 10. Alternatively, the unit can be secured to the walls or base of the container.

Figure 2:
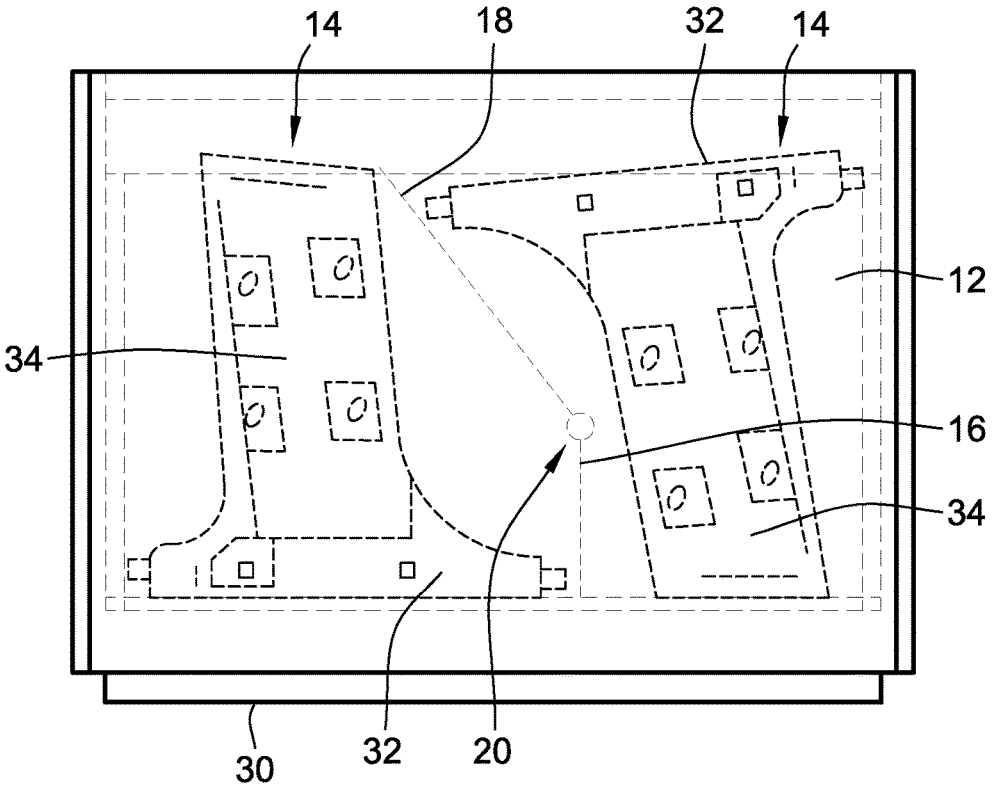
FIG. 2 is a cross-sectional view of the container of FIG. 1 with a first part and a second part in one of the compartments of the container.

As illustrated in FIG. 2, the compartments 12 are each designed to receive two parts 14 having an unconventional shape. In the embodiment shown in the Figures, each part 14 includes a wide portion 32 at one end of the part 14, and a narrow portion 34 (i.e., narrower than the wide portion 32) at the other end of the part 14.

The compartments 12 are defined by a plurality of generally parallel walls 36 that extend from the first side wall 22 to the second side wall 26 of the container body 10. Each compartment 12 can also include a side wall 38 proximate each side wall 22, 26 of the container body 10. Alternatively, the side walls 22, 26 of the container 10 can act as the side walls 38 of the compartments 12 when placed in the container 10. As illustrated in the Figures, the compartments 12 are open at the top to allow for movement of the parts 14 into and out of the compartments 12.

Additionally, the compartments 12 can have a separate bottom wall. Alternatively, the compartments 12 can be open at the bottom and utilize the bottom wall 30 of the container body 10.

A lower portion 19 of the divider panel 16 (i.e., below the pivot point) in each compartment 12 can be separate pieces. Alternatively, the lower portion 19 of the divider panel 16 can be a single piece that extends (or includes a portion that extends) from one end of the container 10 to the other end of the container 10. In this latter embodiment, an appropriate slot would be needed in each of the compartment walls 36 to accommodate the lower portion 19 of the panel 16, or portion thereof.

As shown in the Figures, a separate upper portion 18 of each divider panel 16 is in each of the compartments 12. The upper portions 18 of each of the divider panels 16 extend upward above the walls 36 of the compartments 12. An upper connection piece 40, such as a rod, is connected to the top of each of the upper portions 18 of the divider panels 16. In one embodiment, the upper portions 18 of the divider panels 16 can be connected at one or more locations below the top. In such instances, arcuate slots are needed in the walls 36 of the compartments to accommodate such connections and allow for pivoting of the upper portions 18.

The upper portions 18 of the dividers 16 are hingedly connected to the lower portions 19 of the divider panels 16 by a hinge element at pivot point 20. This enables all of the upper portions 18 of the divider panels 16 to collectively move from a first position to a second position.

Figure 3:
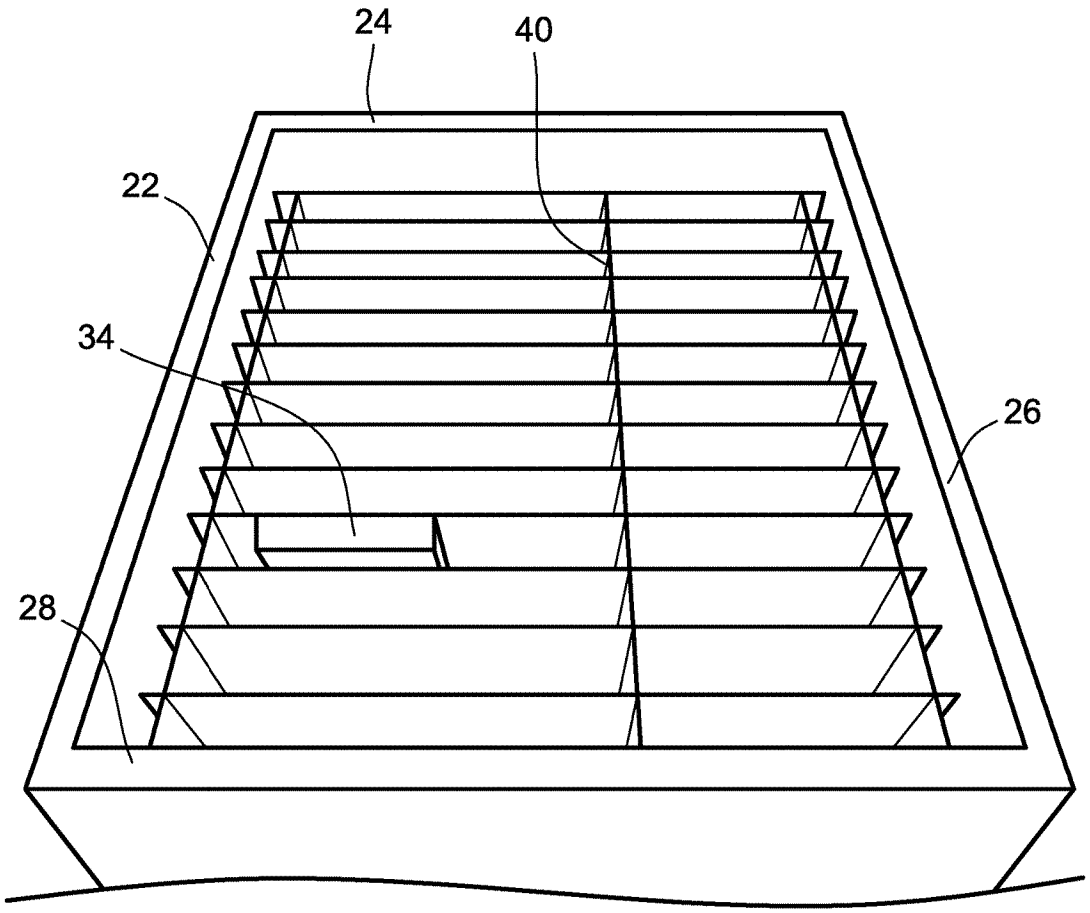
FIG. 3 is a perspective view of the container of FIG. 1 with the divider panel positioned to receive a first part in the compartments; and, FIG. 4 is a perspective view of the container of FIG. 1 with the divider panel positioned to receive a second part in the compartments.

In operation, the upper portions 18 of the divider panels 16 are pivoted toward the second side wall 26 of the container 10 as shown in FIG. 3. This is sometimes referred to as being in an "open" position and allows for loading (or unloading) of a part 14 in the left side of the compartments 12 (directional words, such as left, right, upper, lower etc., are used herein with respect to the position of elements shown in the Figures and are not meant to limit the scope of the invention). As illustrated in FIG. 2, the wider portion 32 of the part 14 is positioned in the bottom of the compartment 12 (also evident in this Figure is that the lower portion 19 of the divider panel 16 is off center). That is, the lower portions 19 of the divider panels 16 are positioned closer to the second side wall 26 to accommodate the wider portion 32 of the part 14 being placed at the bottom of the compartment 12 in the left side.

Figure 4:
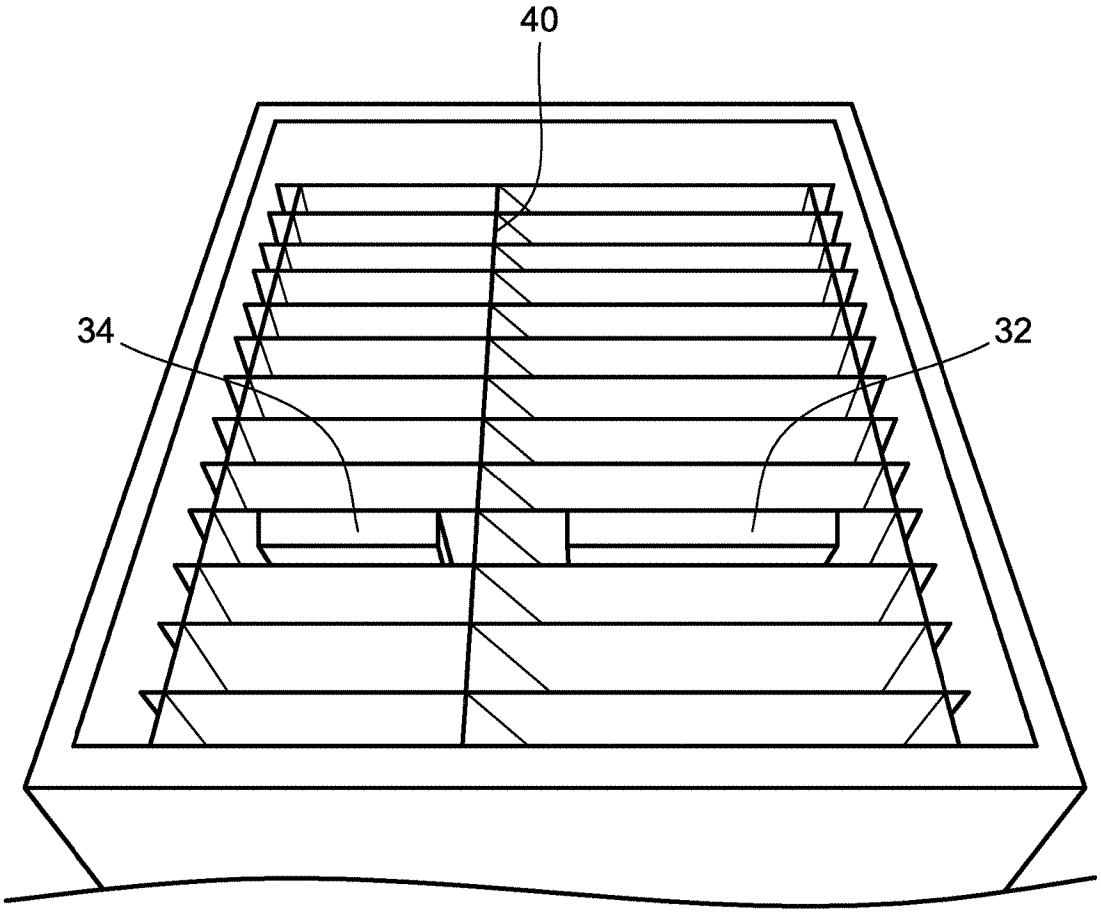

Once the first part 14 is positioned in (or removed from) the left side of the compartment 12, the upper portions 18 of the divider panels 16 are pivoted toward the first side wall 22 (sometimes referred to as the "closed" position), of the container body 10 as illustrated in FIG. 4. This can be done by moving the upper connection piece 40 from one side to the other (a handle can be connected to the upper connection piece 40 to facilitate movement). Alternatively, a knob, or other similar device, can be provided proximate the pivot point 20 to enable rotational movement of the upper portions 18 of the divider panels 16 about the pivot point 20.

When the upper portions 18 of the divider panels 16 are moved toward the first side wall 22 of the container 10, the other part can be placed in the right side of the compartments 12. As illustrated in FIG. 2, the part 14 is positioned in the compartment 12 so that the wider portion 32 of the part 14 is proximate the top of the compartment. The pivotal divider panels 16 thus allow for the container to hold a plurality of parts 14—two in each compartment 12—positioned as shown in FIG. 2.

Although not shown, a lid or top can be provided with the container. Additionally, structure can be provided to facilitate movement of the container. This can include handles connected to the side or end walls 22, 26, 24, 28, and/or a bottom structure configured for use with a fork lift or other similar device. Moreover, the containers can be configured to stack on each other.

Many modifications and variations of the present invention are possible in light of the above teachings. It is, therefore, to be understood within the scope of the appended claims the invention may be protected otherwise than as specifically described.

I claim:

1. A container for carrying a plurality of parts comprising:

a container body having a rectangular bottom wall, a first side wall, a second side wall, a first end wall and a second end wall, the bottom wall, first side wall, second side wall, first end wall and second end wall defining an interior portion;

a plurality of spaced parallel walls in the interior of the container, each of the plurality of walls extending from proximate the first side wall to proximate the second side wall, the spaced walls defining a plurality of compartments in the interior of the container body;

a plurality of divider panels extending upward from the bottom wall, one divider panel in each of the plurality of compartments, wherein each of the plurality of divider panels having at least an upper portion pivotable from a first position to a second position and wherein each of the plurality of divider panels includes a lower divider panel portion hingedly connected to an upper divider panel portion at a pivot point; and, an upper connector piece connected to each of the divider panels.

2. The container of claim 1 wherein each of the lower divider panel portions extends upward from the bottom of the container at a position that is off center with respect to a center of each end wall.

3. The container of claim 2 wherein each of the lower divider panel portions are connected together as a single strip of material.

4. The container of claim 3 wherein the compartments are a separate unit placed in the container body.

5. The container of claim 1 wherein each compartment has a first side wall and a second side wall.

6. The container of claim 5 wherein each compartment has a bottom wall.

7. The container of claim 1 wherein the upper connector piece is a rod.

8. The container of claim 1 wherein the container body is formed from plastic.

9. The container of claim 1 wherein the plurality of compartments are securely connected to the container body.

10. The container of claim 1 wherein the plurality of compartments are not secured to the container body.

11. A container having simultaneously moving divider panels comprising:

a container body having a bottom wall, a first side wall and a second side wall;

a plurality of compartments in an interior of the container body, each compartment including a divider panel having a lower panel portion and an upper panel portion pivotably connected to the lower panel portion wherein each of the upper panel portions of the divider panel are connected together so that each upper panel portion pivots simultaneously with the other upper panel portions.

12. The container of claim 11 wherein the container body further comprises a first end wall and a second end wall.

13. The container of claim 11 wherein each of the upper panel portions of the divider panels are connected to each other at a top portion of each upper panel portion.

14. The container of claim 13 further comprising a connector piece connecting to each of the top portion of each of the upper panel portions.

15. The container of claim 14 wherein the connector piece is a rod.

16. The container of claim 11 wherein each of the lower panel portions of the divider panels are off center with respect to a center line extending from a first end to a second end of the bottom wall.

17. The container of claim 11 further comprising a plurality of end walls defining walls of the compartments.

18. The container of claim 17 wherein each compartment includes a first side wall and a second side wall.

19. The container of claim 11 wherein the container body is formed from plastic.

20. A container for carrying a plurality of parts comprising:

a container body having a rectangular bottom wall, a first side wall, a second side wall, a first end wall and a second end wall, the bottom wall, first side wall, second side wall, first end wall and second end wall defining an interior portion;

a plurality of spaced parallel walls in the interior of the container, each of the plurality of walls extending from proximate the first side wall to proximate the second side wall, the spaced walls defining a plurality of compartments in the interior of the container body;

a plurality of divider panels extending upward from the bottom wall, one divider panel in each of the plurality of compartments, wherein each of the plurality of divider panels having a stationary lower portion and an upper portion pivotable from a first position to a second position; and, an upper connector piece connected to each of the divider panels.

* * * * *